US011993831B1

(12) United States Patent
Smith et al.

(10) Patent No.: US 11,993,831 B1
(45) Date of Patent: May 28, 2024

(54) PRINTABLE HIGH-STRENGTH ALLOYS

(71) Applicant: LOCKHEED MARTIN CORPORATION, Bethesda, MD (US)

(72) Inventors: Scott Wesley Smith, Aptos, CA (US); Servando D. Cuellar, San Francisco, CA (US); Michael A. Reale, San Jose, CA (US); Ivan Audon Lucatero Sanchez, Soquel, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 206 days.

(21) Appl. No.: 17/127,796

(22) Filed: Dec. 18, 2020

(51) Int. Cl.

| | |
|---|---|
| ***C22C 21/00*** | (2006.01) |
| ***B22F 10/10*** | (2021.01) |
| ***B22F 10/20*** | (2021.01) |
| ***B22F 10/31*** | (2021.01) |
| ***B22F 10/36*** | (2021.01) |
| ***B22F 12/00*** | (2021.01) |
| ***B22F 12/40*** | (2021.01) |
| ***C22C 1/04*** | (2023.01) |
| ***C22C 5/06*** | (2006.01) |

(52) U.S. Cl.
CPC ..... *C22C 21/00* (2013.01); *B22F 10/10* (2021.01); *B22F 10/20* (2021.01); *B22F 10/31* (2021.01); *B22F 10/36* (2021.01); *B22F 12/00* (2021.01); *B22F 12/40* (2021.01); *C22C 1/0416* (2013.01); *C22C 5/06* (2013.01); *B22F 2203/00* (2013.01); *B22F 2301/00* (2013.01); *C22C 2202/00* (2013.01)

(58) Field of Classification Search
CPC ..... C22C 21/00; C22C 1/0416; C22C 5/06; C22C 2202/00; C22C 1/0466; B22F 10/10; B22F 10/20; B22F 10/31; B22F 10/36; B22F 12/00; B22F 12/40; B22F 2203/00; B22F 2301/00
See application file for complete search history.

(56) References Cited

U.S. PATENT DOCUMENTS

| | | | |
|---|---|---|---|
| 8,575,474 | B2 | 11/2013 | Salami et al. |
| 2010/0163101 | A1 | 7/2010 | Kumar et al. |

(Continued)

FOREIGN PATENT DOCUMENTS

| | | |
|---|---|---|
| WO | WO2016/150548 | 3/2016 |

OTHER PUBLICATIONS

Yamaguchi et al., "Formation of highly saturated Al-Ag precursor by rapid solidification for skeletal silver synthesis"; 2002; Journal of Alloys and Compounds 336, pp. 206-212 (Year: 2002).*

(Continued)

*Primary Examiner* — Adil A. Siddiqui
(74) *Attorney, Agent, or Firm* — BAKERHOSTETLER

(57) ABSTRACT

Printable high-strength alloys, including aluminum alloys can be produced in an additive manufacturing process. Such alloys can include aluminum-silver ("Al—Ag") alloys that are produced by a laser melting process using a powder bed fusion. The results of the process and the characteristics of the produced alloy can be determined by controlling at least an energy beam power, an energy beam speed, and/or an energy beam size. The operational parameters can be controlled with high precision to produce a printable, high-strength aluminum alloy.

6 Claims, 9 Drawing Sheets

(56) References Cited

U.S. PATENT DOCUMENTS

| | | | |
|---|---|---|---|
| 2018/0245190 | A1 | 8/2018 | Snyder et al. |
| 2019/0032175 | A1 | 1/2019 | Martin et al. |

OTHER PUBLICATIONS

Taher et al., "The influence of chemical and phase composition on mechanical, tribological and electrical properties of Silver-Aluminum alloys"; Tribology International 119 (2018) pp. 680-687 (Year: 2018).*

* cited by examiner (a)
Alloy 2: Composition (wt.%): 50% Al, 50% Ag

(b)
Alloy 1: Composition (wt.%): 60% Al, 40% Ag

PRINTABLE HIGH-STRENGTH ALLOYS

STATEMENT REGARDING FEDERALLY SPONSORED RESEARCH OR DEVELOPMENT

Not applicable.

TECHNICAL FIELD

The present description relates in general to high-strength alloys, and more particularly to, for example and without limitation, printable high-strength alloys and methods of production.

BACKGROUND OF THE DISCLOSURE

Additive manufacturing (AM) is a workpiece manufacturing process by which a workpiece is manufactured one layer at a time. AM has certain advantages over traditional manufacturing techniques, including less wasted material and reduced labor costs.

There are several different types of AM processes, including, for example, powder bed processes, material deposition processes, and three-dimensional (3D) printing processes. Powder bed processes involve a heating apparatus, such as a laser or electron beam, that fuses a powder, such as stainless steel, cobalt-chrome alloys, or titanium alloys, for example, in accordance with a slice plot one layer at a time to form a workpiece.

The description provided in the background section should not be assumed to be prior art merely because it is mentioned in or associated with the background section. The background section may include information that describes one or more aspects of the subject technology.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

A variety of products and applications require the use of high-strength materials, such as aluminum alloys. These can be made by conventional methodologies, such as casting, bolting together, and/or machining. However, it would be desirable to provide printable high-strength alloys to reduce processing time and manufacturing costs. Typical additive manufacturing ("AM") techniques do not support the ability to build (e.g., print) high-strength aluminum alloys. High-strength aluminum alloys have producibility issues when using the wrought chemistry for powder bed fusion. Therefore, the development and maturation of a high-strength aluminum alloy that supports AM techniques (i.e. printable) would have the benefits of additive manufacturing techniques and provide high-strength characteristics.

The present disclosure provides techniques for producing printable high-strength alloys, including aluminum alloys. For example, such alloys can include aluminum-silver ("Al—Ag") alloys that are produced by a laser melting process using a powder bed fusion. The results of the process and the characteristics of the produced alloy can be determined by controlling at least an energy beam power, an energy beam speed, and/or an energy beam size. The operational parameters can be controlled with high precision to produce a printable, high-strength aluminum alloy.

Such alloys can have a wide range of applications, particularly where structures having high strength-to-weight ratios are desired. Such applications can include, for example, structures for aerospace applications.

While other techniques offer particular blends of aluminum alloy solutions with various properties, the present disclosure provides an ability to tailor the process via heat treatment to balance ultimate tensile strength ("UTS") and yield strength ("YS") with elongation requirements.

Figure 1:
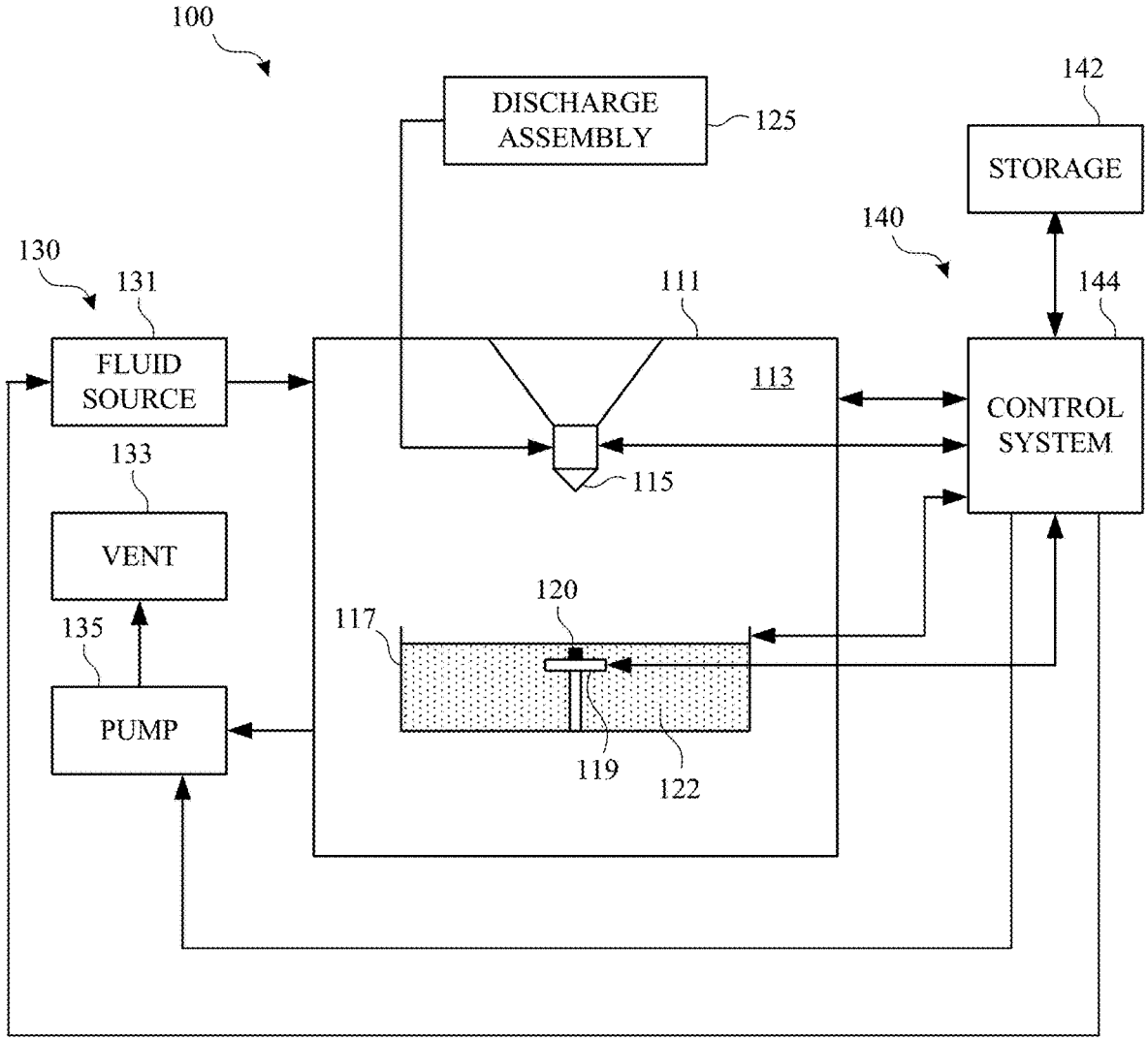
FIG. 1 shows a schematic diagram of an example of a system for fabricating a structure with powder bed fusion, according to some embodiments of the present disclosure.

FIG. 1 shows a schematic diagram of an example of a system for fabricating a structure with powder bed fusion, according to some embodiments of the present disclosure. Powder bed fusion ("PBF") technology is used in a variety of additive manufacturing ("AM") processes. Examples of additive manufacturing processes include direct metal laser sintering ("DMLS"), selective laser sintering ("SLS"), selective heat sintering ("SHS"), electron beam melting ("EBM") and direct metal laser melting ("DMLM"). Systems employing powder bed fusion can use a source of energy, such as lasers, electron beams, and/or thermal print heads to melt or partially melt layers of material in a three-dimensional space. As the process concludes, excess powder can be removed from the structure that has been formed.

As shown in FIG. 1, a free-form structure 120 can be fabricated by a system 100. The system 100 can include a processing chamber 111 for enclosing a formation environment 113. Within the formation environment 113, the system 100 can include a powder bed container 117 containing a powder bed 122. The powder bed 122 can include a matrix powder. In some embodiments, the powder bed can include powders of one or more metals. For example, the powder bed can include aluminum powder and/or silver powder, as discussed further herein. Where multiple metal powders are provided, the powders can be provided in a relative amount (e.g., by wt. %) according to a desired composition of the structure 120 to be fabricated. While aluminum and silver can be included, other additives can be included, such as other metals, buffers, matrix materials, and/or catalyst materials. It will be understood that any or all of such additives can be omitted.

The system 100 can include an energy source 125 that generates a beam of energy for achieving fusion. In use, the energy source 125, such as a high-powered laser, directs energy (e.g., as a fusing agent) from an emission head 115 to subject discrete portions of the powder bed 122 to the energy (e.g., in the form of a beam). Accordingly, the free-form structure 120 is created from fused sections within the powder bed 122. Other examples of an energy source include, among others, an election beam device, a chemical vapor deposition system, a thermal spray device, a plasma deposition device, and a molecular beam epitaxi system.

A worktable 119 may be provided within the container 117 to position the free-form structure 120 during fabrication. Optionally, a baseplate can be provided for fusing with the free-form structure 120 upon fabrication.

The system 100 can further include a positioning assembly 140 operably connected to one or more elements within the processing chamber 111. For example, the positioning assembly 140 can include a control system 144. The control system 144 implements program sequences for arranging material for formation of the free-form structure with the applied energy. The control system 144 can include executable instructions for controlling the parameters for fabrication, thereby controlling the conditions under which the free-form structure 120 is formed. For example, the control system 144 can operably control the energy source 125, the emission head 115 and/or the worktable 119, among others.

The positioning assembly 140 can include storage 142 coupled with the control system 144. The storage 142 stores instructions, procedures, templates, and/or other information associated with fabrication of the free-form structure 120. The control system 144 can include or be connected to an interface to communicate with other devices and/or a user for receiving inputs and providing outputs.

In operation, the control system 144 instructs the emission head 115 to be positioned relative to the worktable 119. It will be understood that such motion can be achieved by moving the emission head 115 and/or other powder bed (e.g., via the container 117 and/or the worktable 119. Such motion can be translational and/or rotational. The elements can include or be connected to moving elements, such as actuators, motors, shuttles, trays, arms, and the like. The energy can thereby be applied to target locations in a controlled manner.

The control system 144 can establish optimal conditions within the formation environment 113 for the fabrication of the free-form structure 120. The emission head 115 can apply a fusing agent (e.g., beam of energy) from the energy source 125 (e.g., laser) to the powder bed 122. The control system 144 can monitor conditions of the fusion to determine whether and how to control parameters of operation to achieve the effects and results discussed further herein.

For example, to ensure that the formation environment 113 facilitates optimal creation of a free-form structure, the system 100 can optionally include an environmental control system 130 in operative engagement with the interior of the processing chamber 111. In particular, as shown in FIG. 1, the environmental control system 130 includes an environmental operating fluid source 131 for supplying an operating fluid to the interior of the processing chamber 111 to define the atmosphere included by the formation environment 113. Accordingly, the operating fluid is transferred from the source 131 to the formation environment 113 via an inlet in communication with the interior of the processing chamber 111. The operating fluid can include, among others, an inert gas, such as argon or nitrogen for introduction into the processing chamber 111.

The environmental control system 130 includes one or more pumps 135 for extracting waste fluid from the formation environment 113. The term waste fluid refers to unwanted fluids resulting from the fabrication of the free-form structure 120. An outlet, in communication with the interior of the processing chamber 111, removes waste fluid from the formation environment 113 as driven by the one or more pumps 135. The waste fluid can then be exhausted from the system 100 via a vent 133 in operative engagement with the outlet.

Figure 2:
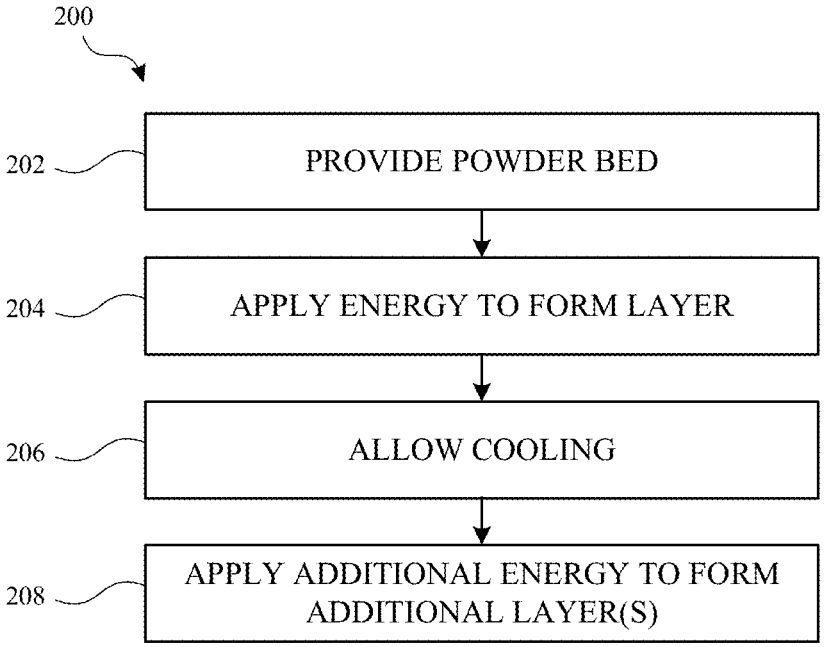
FIG. 2 shows a method for fabricating a structure with powder bed fusion, according to some embodiments of the present disclosure.

FIG. 2 illustrates a flow chart for a process for fabricating a free-form structure, according to some embodiments of the present disclosure. For explanatory purposes, the process 200 is primarily described herein with reference to the system 100 of FIG. 1. However, the process 200 is not limited to the system 100 of FIG. 1. Further, for explanatory purposes, the blocks of the process 200 are described herein as occurring in serial, or linearly. However, multiple blocks of the process 200 may occur in parallel. In addition, the blocks of the process 200 need not be performed in the order shown and/or one or more blocks of the process 200 need not be performed and/or can be replaced by other operations.

The process 200 can begin with the provision of a system with a powder bed having a desired composition (202). The composition can be provided prior to or during performance of other operations. The powder bed can further be provided with a desired amount (e.g., depth) over a worktable 119.

An energy source or other mechanism can apply energy to the powder bed to form a layer of a structure (204). The energy can be provided as a beam from a laser. Additionally or alternatively, the energy can be provided in other forms, such as from an election beam device, a chemical vapor deposition system, a thermal spray device, a plasma deposition device, and/or a molecular beam epitaxi system.

The layer of the free-form structure formed via the application of energy can be allowed to cool (206). The temperature and/or other conditions can be controlled to maintain the micro-structures of the free-form structure, as described further herein.

The energy source or other mechanism can apply additional energy to the powder bed to form one or more additional layers to a previously formed layer (208). The process can be repeated as desired to produce the free-form structure from multiple layers.

Figure 3:
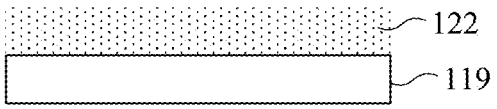
FIG. 3 shows a worktable and a powder bed in a stage of fabricating a structure, according to some embodiments of the present disclosure.

Referring now to FIGS. 3-7, the free-form structure can be formed from multiple layers of fused material. As shown in FIG. 3, the powder bed 122 can be provided on a worktable 119.

Figure 4:
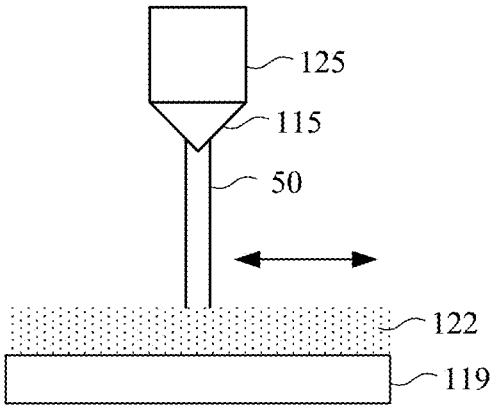
FIG. 4 shows the worktable and the powder bed of FIG. 3 in another stage of fabricating the structure with a beam of energy, according to some embodiments of the present disclosure.

As shown in FIG. 4, the energy source 125 or other mechanism can apply energy to a first portion of the powder bed 122. The energy can be provided as a beam 50 from an emission head 115. The emission head 115 and/or the powder bed 122 (via the worktable 119) can be moved relative to each other to distribute the energy across a desired shape and/or pathway.

Structures can be fabricated to have desirable properties based on a process in which a particular energy density is applied. It will be understood that the parameters of energy application can be controlled to achieve application of a particular energy density ($J/mm^3$). For example, the applied energy density of a beam applied to the powder bead can be between 11 and 57 $J/mm^3$. Structures fabricated by application of such energy densities were found to have desirable density and porosity properties, as described further herein. Accordingly, the strength properties of the structures were correspondingly desirable.

In some embodiments, the energy density is controlled by controlling the relative speed of movement between the emission head 115 and/or the powder bed 122 (via the worktable 119). Faster movement speed distributes a given amount of energy output with the beam across a larger volume, thereby reducing energy density. In contrast, slower movement speed distributes a given amount of energy output with the beam across a smaller volume, thereby increasing energy density.

In some embodiments, the energy density is controlled by controlling the energy output rate from the emission head 115. A higher energy output rate increases the amount of energy output within a given amount of time. In contrast, a lower energy output rate decreases the amount of energy output within a given amount of time.

In some embodiments, the energy density is controlled by controlling the size of the beam 50. For a given energy output, a larger beam (e.g., cross-sectional area or area of intersection with powder bed 122) distributes a given amount of energy output across a larger volume, thereby reducing energy density. In contrast, a smaller beam concentrates a given amount of energy output within a smaller volume, thereby increasing energy density.

It will be understood that one or more than one parameter can be adjustably controlled at any given time to alter or maintain energy density. For example, different parameters can be controlled in different ways to adjust and/or maintain the energy density at a given level.

Figure 5:
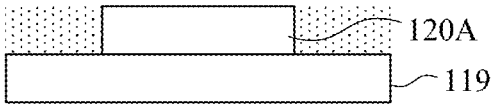
FIG. 5 shows the worktable of FIG. 4 with a first layer of the structure in another stage of fabrication, according to some embodiments of the present disclosure.

As shown in FIG. 5, the first portion of the powder bed 122 that received the energy can be fused into a first layer 120A. The first layer 120A can optionally be allowed to cool.

Figure 6:
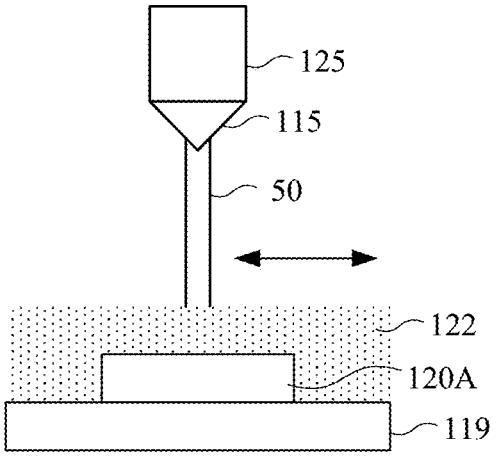
FIG. 6 shows the worktable and the powder bed of FIG. 5 in another stage of fabricating the structure with a beam of energy, according to some embodiments of the present disclosure.

As shown in FIG. 6, the energy source 125 or other mechanism can apply additional energy to a second portion of the powder bed 122 that is over the first layer 120A. The energy can be provided as a beam 50 from an emission head 115 as in a prior operation or with different parameters. The emission head 115 and/or the powder bed 122 (via the worktable 119) can again be moved relative to each other to distribute the energy across a desired shape and/or pathway.

Figure 7:
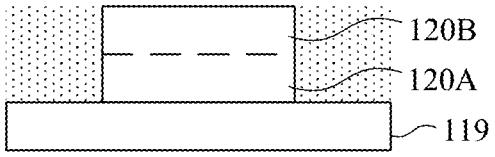
FIG. 7 shows the worktable of FIG. 6 with first and second layers of the structure in another stage of fabrication, according to some embodiments of the present disclosure.

As shown in FIG. 7, the second portion of the powder bed 122 that received the additional energy can be fused into a second layer 120B. The first layer 120A and the second layer 120B can be fused to each other to form a monolithic structure. The process can be repeated as desired to produce the free-form structure from multiple layers. It will be understood that structures can be formed with any number of layers. The layers can have the same or different properties based on fabrication under the same or different parameters.

Structures fabricated according to the description provided here were analyzed to determine properties thereof. Custom powder was inert gas atomized, classified, analyzed, and prepared for laser powder bed fusion ("LPBF") additive manufacturing. Mechanical test samples were directly printed from the powder bed and tested. A suite of high mechanical property test samples were developed and tailored with heat treatment to meet product requirements. For a variety of heat treatment conditions, mechanical properties were found to exceed those of COTS 7000 series aluminum alloys. A wide range of exceptional mechanical property values were observed based on the heat treatment applied. In one case, a 2 hour heat treatment to one blend of Ag Alloy produced a product with greater than 90 ksi UTS and greater than 70 YS, which exceed published data for at least some 7000 series aluminums via conventional methodologies.

Accordingly, alloy structures described herein were found to provide a solution to the technical problem of requiring a high-strength alloy with a good strength-to-weight ratio while also being thermally conductive. The fabrication techniques of the present disclosure were found to provide design flexibility for secondary structures where 6061 and 7075 fall short in strain capability and mechanical properties.

For example, the table below shows the properties for various materials, including aluminum alloys (A356, 6061, 7075), nickel alloy (201), Al—Ag alloys of the present disclosure ("Al—Ag Alloy"), and a titanium alloy (Ti-6Al-4V).

TABLE 1

| | Property | | | | | |
|---|---|---|---|---|---|---|
| | A356 | 6061 | 7075 | 201 | Al—Ag Alloy | Ti—6Al—4V |
| YS ksi | 24 | 40 | 73 | 60 | 29-99 | 128 |
| UTS ksi | 33 | 45 | 83 | 68 | 49-115 | 138 |
| Elongation, % | 3 | 17 | 11 | 7-8 | 3-21 | 14 |
| TC'y, W/(mK) | 151 | 167 | 130 | 121 | 40-105 | 6.7 |
| Density, g/cc | 2.7 | 2.7 | 2.8 | 2.8 | 4.3 | 4.3 |

These properties demonstrate that the Al—Ag alloys of the present disclosure fill needs for properties that are between aluminum alloys and titanium and/or steel alloys. In addition, the properties are controllable based on the parameters and conditions of the LPBF AM process that is applied (e.g., energy application).

Al—Ag alloys described herein can include both aluminum and silver. For example, an Al—Ag alloy can include 10 wt. %, 20 wt. %, 30 wt. %, 40 wt. %, 50 wt. %, 60 wt. %, 70 wt. %, 80 wt. %, 90 wt. % aluminum. The balance can be silver. By further example, an Al—Ag alloy can include 10 wt. %, 20 wt. %, 30 wt. %, 40 wt. %, 50 wt. %, 60 wt. %, 70 wt. %, 80 wt. %, 90 wt. % silver. The balance can be aluminum. By further example, an Al—Ag alloy can include 20-80 wt. % aluminum and 20-80 wt. % silver. By further example, an Al—Ag alloy can include 30-70 wt. % aluminum and 30-70 wt. % silver. By further example, an Al—Ag alloy can include 50-60 wt. % aluminum and 40-50 wt. % silver. While the Al—Ag alloy can include exclusively aluminum and silver in some embodiments, it will be understood that in other embodiments additives can be included, such as other metals, buffers, matrix materials, and/or catalyst materials.

Figure 8:
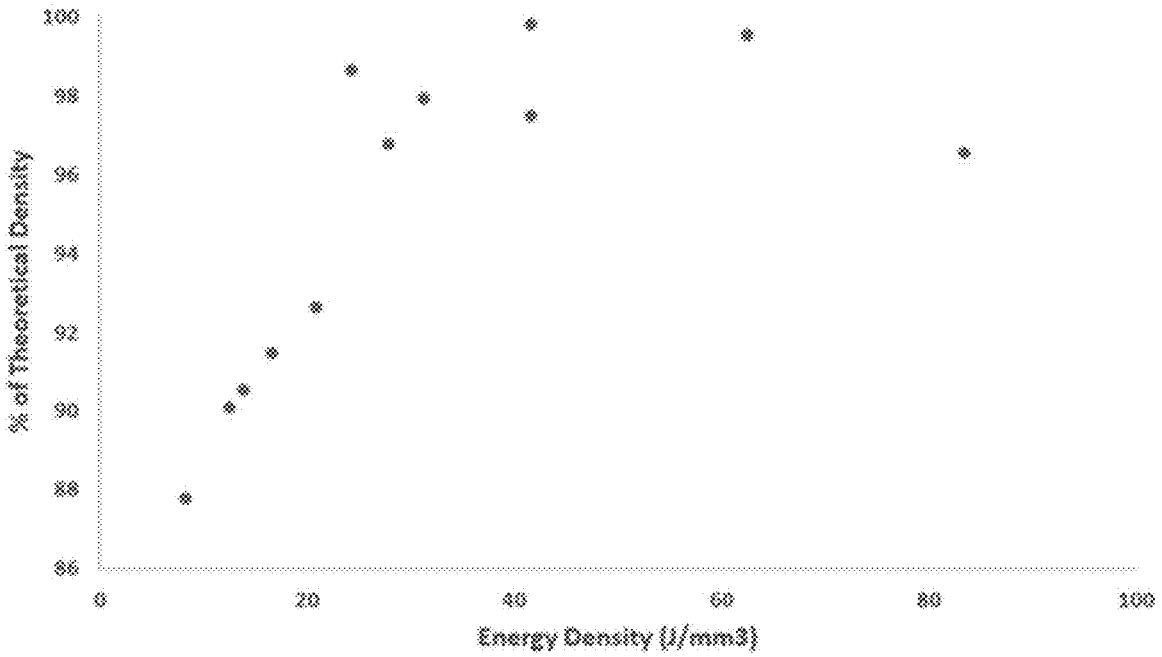
FIG. 8 shows a chart of Archimedes densities (as a percentage of a theoretical maximum density of the alloy) of sample structures of an Al—Ag alloy for various applied energy densities during powder bed fusion processes, according to some embodiments of the present disclosure.

FIG. 8 shows a chart of Archimedes densities (as a percentage of a theoretical maximum density of the alloy) of sample structures of an Al—Ag alloy for various applied energy densities during powder bed fusion processes, according to some embodiments of the present disclosure. As shown in FIG. 8, the samples providing an example of an alloy were analyzed for density properties. The alloy contained 50 wt. % aluminum and 50 wt. % silver (formed from a powder bed of 50 wt. % aluminum and 50 wt. % silver). No other additives were included in the alloy.

Sample structures were fabricated with LPBF AM techniques described herein with application of various energy densities. The Archimedes densities were calculated as a percentage of a theoretical maximum density. The theoretical maximum density can be one that can be calculated for the alloy in a particular (e.g., ideal) arrangement, such as but not limited to a hexagonal close-packed crystal arrangement. For example, for the alloys analyzed, the theoretical maximum density of each alloy (e.g., theoretical density) is 4.3 g/cm 3. As shown in FIG. 8, the densities of the structures can vary with the energy density of the applied beam of energy. Favorable densities of the structures (e.g., greater than 90%) were found with applied energy densities between 11 and 57 J/mm$^3$. In particular, densities of the structures greater than 95% were found with applied energy densities between 18 and 57 J/mm$^3$.

Figure 9:
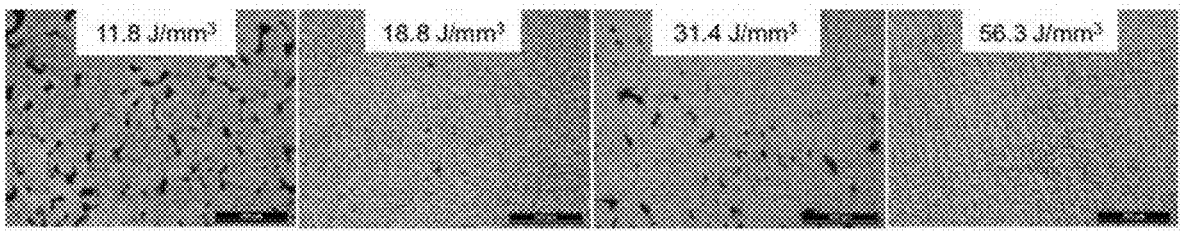
FIG. 9 shows images of sample structures of an Al—Ag alloy having different porosities resulting from various applied energy densities during powder bed fusion processes, according to some embodiments of the present disclosure.

FIG. 9 shows images of sample structures of an Al—Ag alloy (e.g., alloy of FIG. 8) having different porosities resulting from various applied energy densities during powder bed fusion processes, according to some embodiments of the present disclosure. Larger porosity results appear to be from localized lack of fusion. As shown in FIG. 9, the porosities can vary with applied energy densities. However, the porosities formed within different alloys were largely similar for any given applied energy density. Accordingly, by controlling the energy density, both density and porosity of the fabricated structure, as well as related strength properties, can be controlled.

Figure 10:
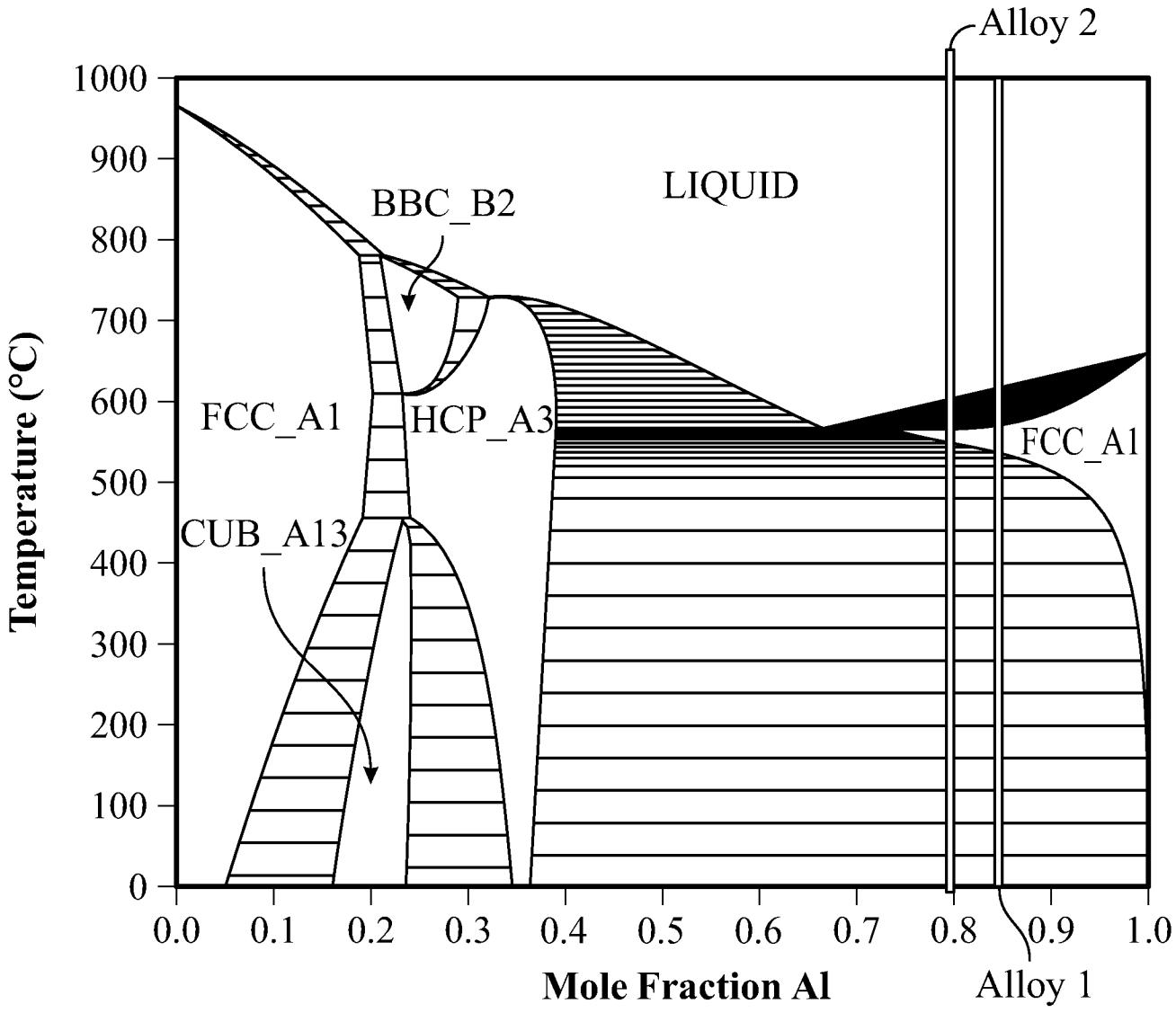
FIG. 10 shows a phase diagram of Al—Ag alloys, including the alloy of FIG. 8, for various mole fractions of aluminum and at various temperatures, according to some embodiments of the present disclosure.
Figure 11:
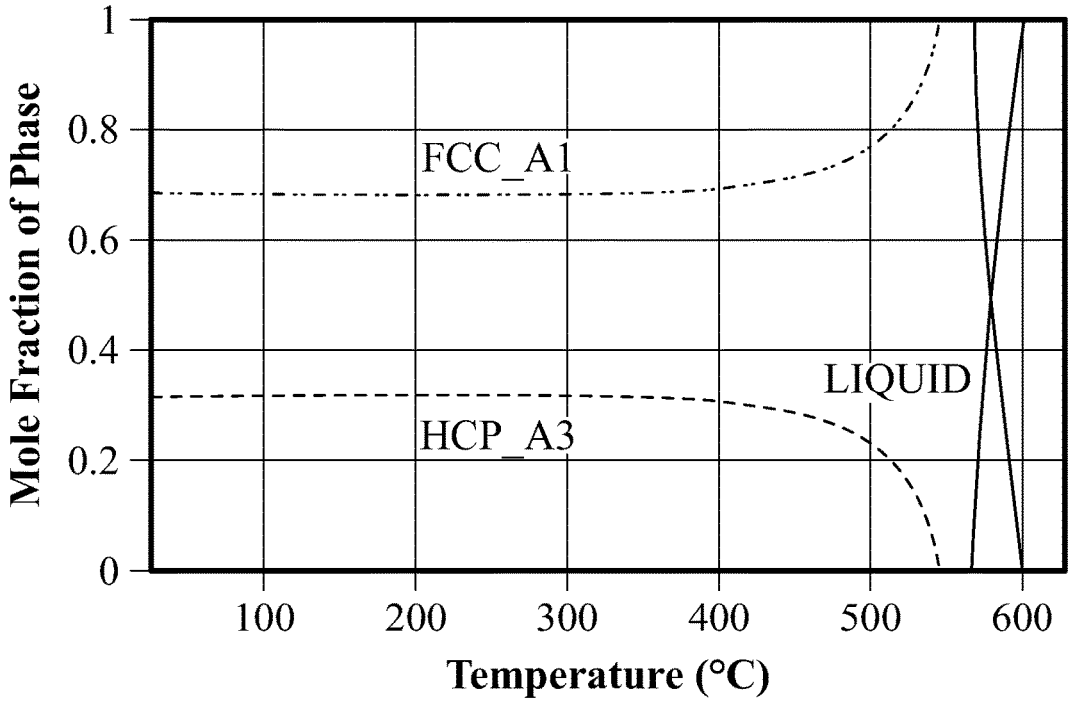
FIG. 11 shows mole fraction data for various mole fractions in a given phase and at various temperatures for Al—Ag alloys, according to some embodiments of the present disclosure.
Figure 11:
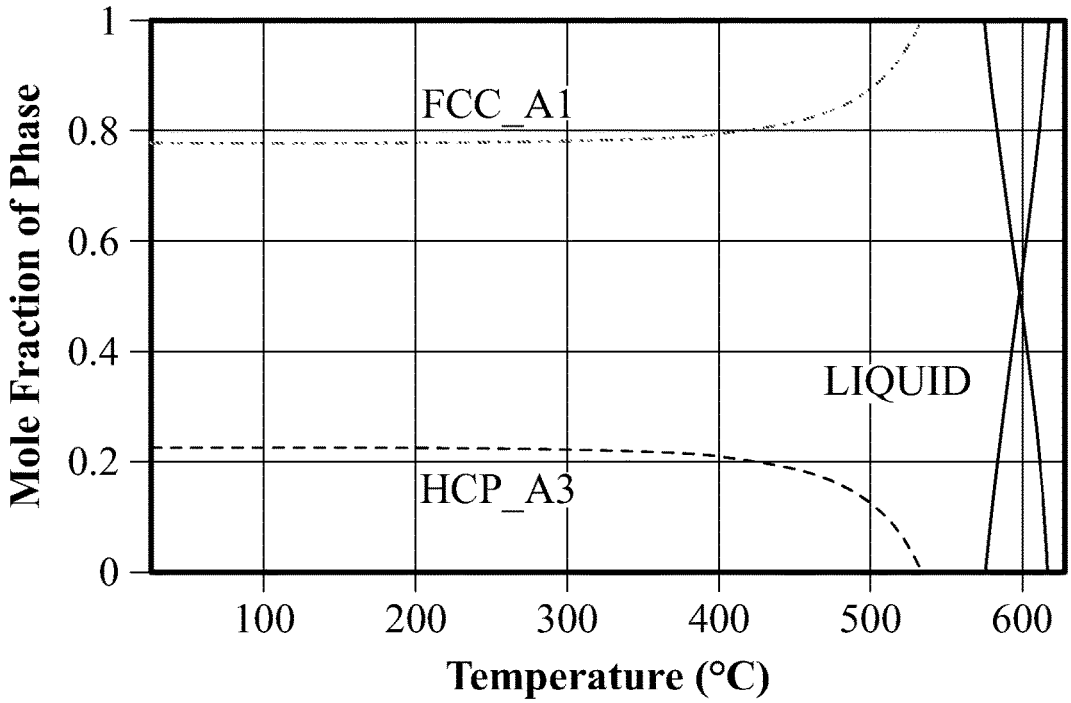
Figure 12:
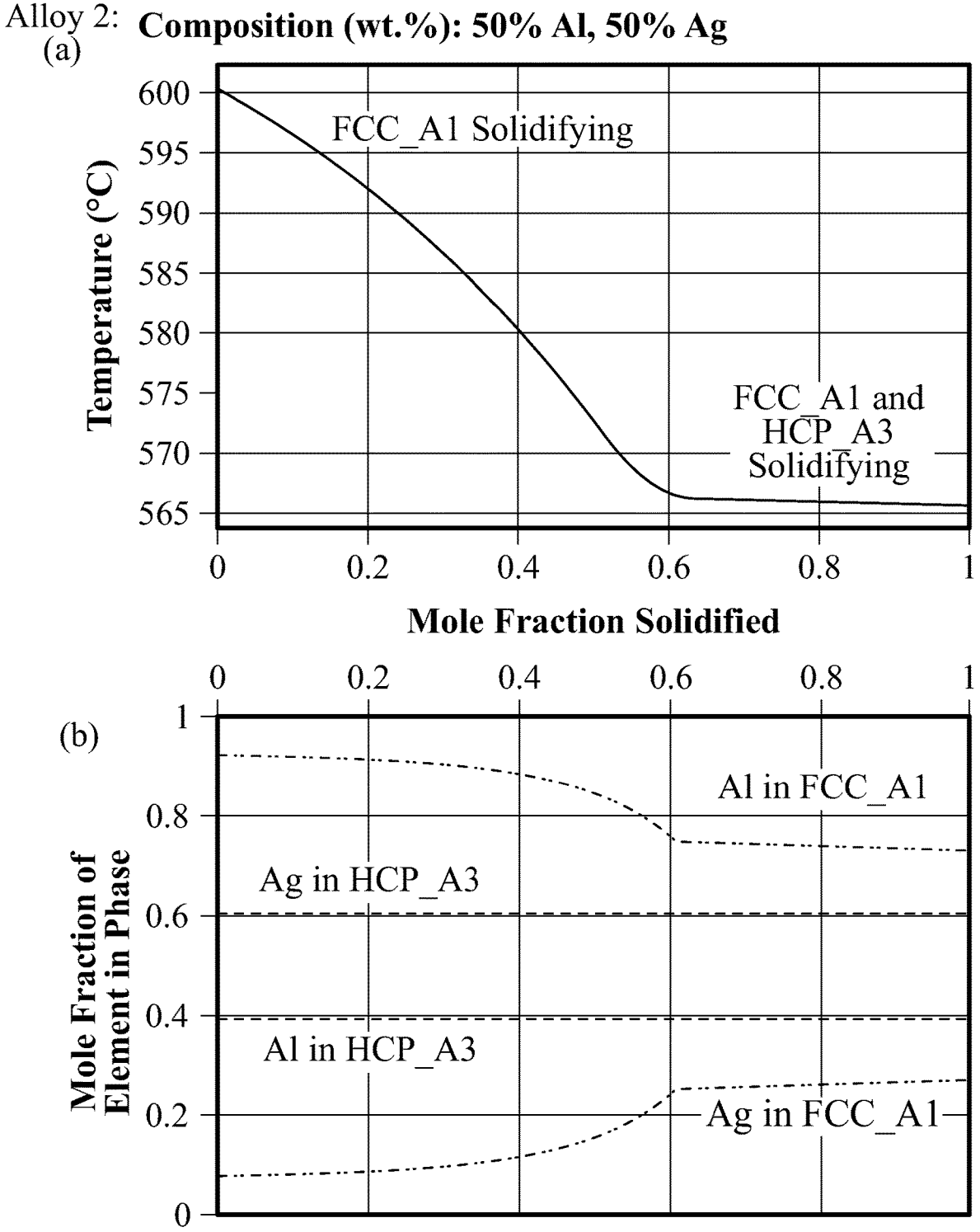
FIG. 12 shows charts comparing (a) mole fraction solidified for various temperatures and (b) mole fraction of each element in the hexagonal close-packed ("HCP") and the face-centered cubic ("FCC") phases for an Al—Ag alloy, according to some embodiments of the present disclosure.

FIG. 10 shows a phase diagram of Al—Ag alloys (e.g., "Alloy 1" containing 60 wt. % aluminum and 40 wt. % silver and "Alloy 2" as the alloy of FIG. 8) for various mole fractions of aluminum and at various temperatures, according to some embodiments of the present disclosure. FIG. 11 shows mole fraction data for various mole fractions in a given phase and at various temperatures for Al—Ag alloys, according to some embodiments of the present disclosure. FIG. 12 shows charts comparing (a) mole fraction solidified for various temperatures and (b) mole fraction of each element in the hexagonal close-packed ("HCP") and the face-centered cubic ("FCC") phases for an Al—Ag alloy, according to some embodiments of the present disclosure.

As shown in FIGS. 10-12, the phases of the constituent elements of the alloy are temperature-dependent. The other mechanical properties described herein also correspond to the temperature of the fabrication process as well as maintenance below certain temperatures after fabrication. For example, the structure can be held on a buildplate that is maintained below 500° C. during and/or after a fabrication process to achieve and maintain the phase arrangement of the alloy. Accordingly, the structure can be formed from the powder bed by applying energy while maintaining the buildplate below 500° C. while and/or after applying the energy.

As shown in FIG. 12, in a solid state, a mole fraction of each element can be in a particular phase. For example, the mole fraction of aluminum in the FCC phase can be 60-80%, and the mole fraction of silver in the FCC phase can be 20-40%. By further example, the mole fraction of aluminum in the HCP phase can be 30-50%, and the mole fraction of silver in the HCP phase can be 50-70%.

Figure 13:
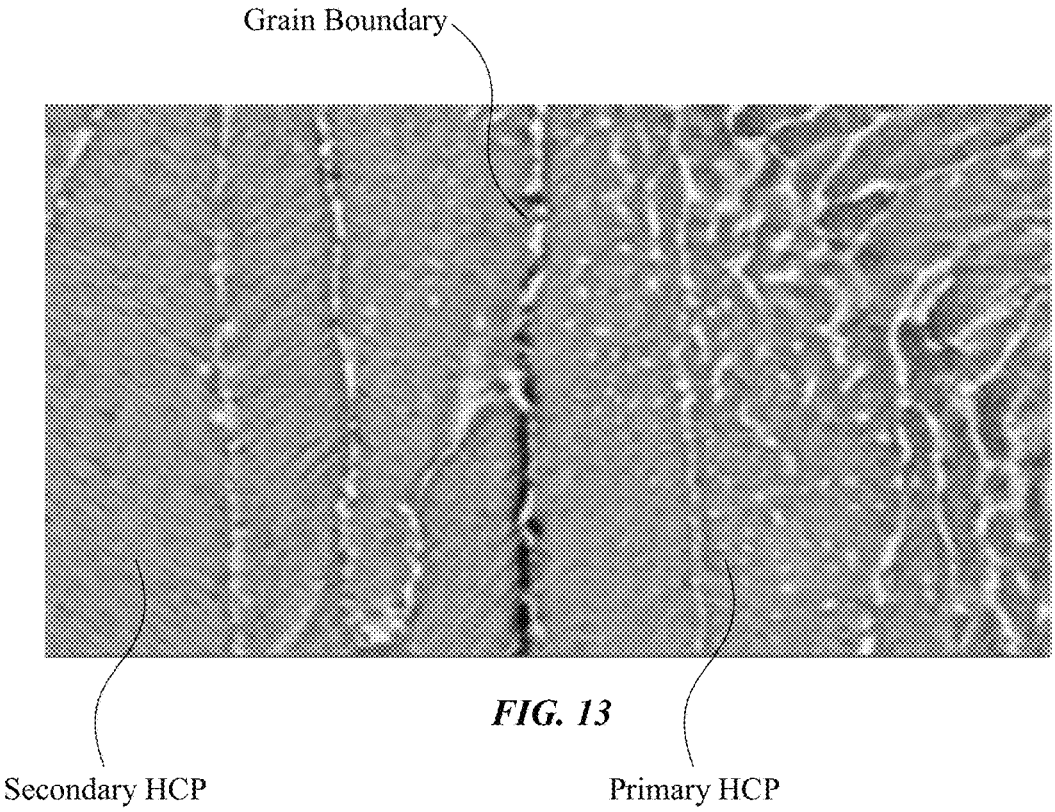
FIG. 13 shows an image of a sample structure of an Al—Ag alloy forming a grain boundary as well as primary and secondary HCP phases, according to some embodiments of the present disclosure.

FIG. 13 shows an image of a sample structure of an Al—Ag alloy forming a grain boundary as well as primary and secondary HCP phases, according to some embodiments of the present disclosure. Such grain boundaries can be formed based on temperature gradients and/or cooling profiles across the structure. The heavier elements (e.g., silver) in the alloy can segregate towards and solidify at the grain boundaries.

As further shown in FIG. 13, the primary and secondary HCP phases can form, for example, in different regions. The primary HCP phases can form during rapid solidification of the material. These can form as continuous phases located along the grain boundaries. The secondary HCP phases can form from the solid as thin needles or platelets within the matrix.

The primary and secondary HCP phases can have different morphologies and may lead to varying mechanical properties, which can be controlled for desirable outcomes.

Figure 14:
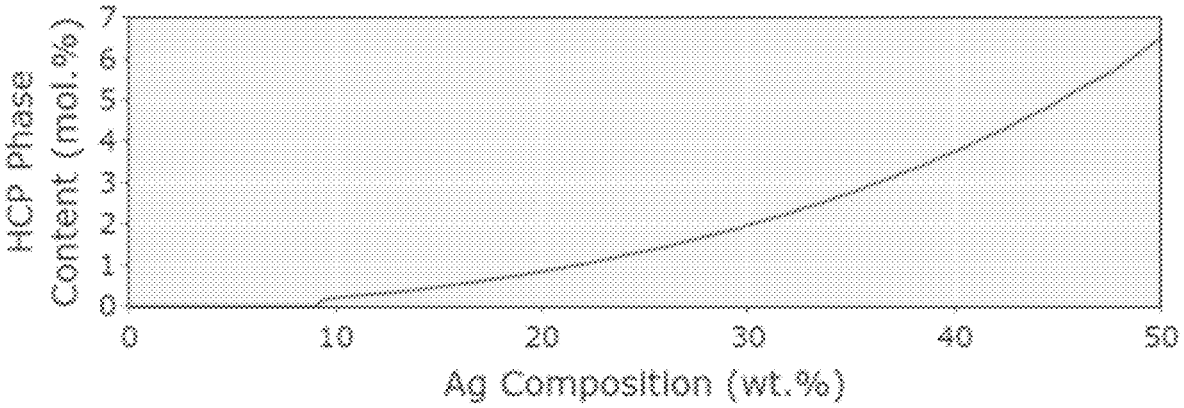
FIG. 14 shows a chart comparing HCP phase content for various silver compositions (wt. %) for Al—Ag alloys, according to some embodiments of the present disclosure.

FIG. 14 shows a chart comparing HCP phase content (mol. %) for various silver compositions (wt. %) for Al—Ag alloys, according to some embodiments of the present disclosure. As shown in FIG. 14, the HCP phase content increases as silver content increases. Reducing the HCP fraction was found to improve the crack resistance of the fabricated structure by reducing brittle regions that can otherwise provide paths for crack propagation. If a significant volumetric mismatch exists between HCP and FCC phases, reducing HCP phase will reduce stress accumulation due to the volumetric mismatch. In particular, reducing the HCP phase will reduce the continuous phase at the columnar grain boundary and thereby lead to higher overall strength.

Figure 15:
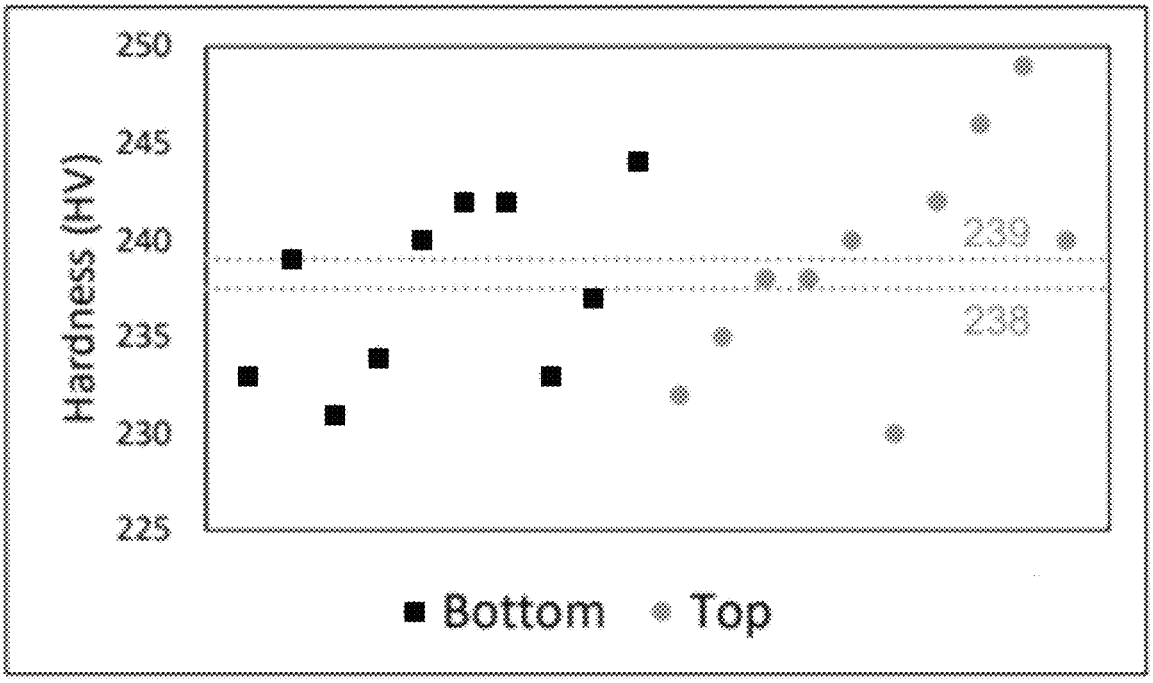
FIG. 15 shows a chart comparing hardnesses of the top and bottom layers of structures, according to some embodiments of the present disclosure.

FIG. 15 shows a chart comparing hardnesses of the top and bottom layers of structures, according to some embodiments of the present disclosure. It will be understood that the top and bottom layers of the fabricated structure will have different thermal histories based on the process of forming the structure in successive layers (i.e., with the bottom layer first and the top layer last). As such, bottom layers are subjected to more heat treatment for longer durations of time than are top layers. Such a difference in thermal histories suggests a possibility for differences in the solid-state HCP transformation, higher HCP fraction, and higher hardness. High hardness would suggest low ductility. The combination of a brittle material and high residual stress can cause crack formation and delamination from a baseplate. However, as shown in FIG. 15, the hardness results do not suggest that a meaningful different in HCP fraction exists between the top and bottom layers. Indeed, there was found to be greater variation in hardness among each type of layer than across different types of layers.

Across various sample structures, there were no clear trends in measured hardness based on variations in energy density, alloy formulation, or location relative to baseplate (e.g., z-axis). This suggest that there are no major microstructural differences across different energy density, alloy formulation, or location relative to baseplate. At the same time, various samples of AgAl alloys were found to have lower hardness than certain other AM processed material, such as Ti64 (titanium alloy) and IN718 (nickel alloy).

Accordingly, printable high-strength alloys, including aluminum alloys can be produced in an additive manufacturing process. Such alloys can include aluminum-silver ("Al—Ag") alloys that are produced by a laser melting process using a powder bed fusion. The results of the process and the characteristics of the produced alloy can be determined by controlling at least an energy beam power, an energy beam speed, and/or an energy beam size. The operational parameters can be controlled with high precision to produce a printable, high-strength aluminum alloy.

Various examples of aspects of the disclosure are described below as clauses for convenience. These are provided as examples, and do not limit the subject technology.

Clause A: a method for producing a structure, the method comprising: providing a powder bed comprising 50-60 wt. % aluminum and 40-50 wt. % silver; and forming the structure as an alloy from the powder bed by applying energy to a portion of the powder bed, the energy being applied with an energy density between 11 and 57 J/mm$^3$.

Clause B: a structure comprising: an alloy of: 50-60 wt. % aluminum; and 40-50 wt. % silver, wherein the structure has a density that is at least 90% of a theoretical maximum density of the alloy.

Clause C: a system comprising: a container holding a powder bed comprising aluminum and silver; an energy source for directing a beam of energy to the powder bed; a controller configured to control the beam of energy, such that the beam applies an energy density of between 11 and 57 J/mm$^3$ to the powder bed.

One or more of the above clauses can include one or more of the features described below. It is noted that any of the following clauses may be combined in any combination with each other, and placed into a respective independent clause, e.g., clause A, B, or C.

Clause 1: the energy is applied with a laser.

Clause 2: the portion of the powder bed is a first portion of the powder bed; and the method further comprises applying additional energy to a second portion of the powder bed, the second portion being adjacent to the first portion.

Clause 3: forming the structure comprises forming, from the powder bed, multiple overlapping layers with separate applications of the energy.

Clause 4: the portion of the powder bed formed into the structure is held on a buildplate that is maintained below 500° C.

Clause 5: the energy is from a beam, and movement of the beam with respect to a worktable is adjustably controlled to maintain the energy density between 11 and 57 J/mm$^3$.

Clause 6: the energy is from a beam, and a power output of the beam is adjustably controlled to maintain the energy density between 11 and 57 J/mm$^3$.

Clause 7: the energy is from a beam, and a size of the beam is adjustably controlled to maintain the energy density between 11 and 57 J/mm$^3$.

Clause 8: the structure has a density that is at least 95% of the theoretical maximum density of the alloy.

Clause 9: the structure comprises 50 wt. % aluminum and 50 wt. % silver.

Clause 10: the structure comprises 60 wt. % aluminum and 40 wt. % silver.

Clause 11: a mole fraction of at least some of the alloy in an HCP phase is between 30% and 50%, and a mole fraction of at least some of the alloy in the HCP phase is between 50% and 70%.

Clause 12: a mole fraction of at least some of the alloy in an FCC phase is between 60% and 80%, and a mole fraction of at least some of the alloy in the FCC phase is 20% and 40%.

Clause 13: the energy source comprises a laser.

Clause 14: a worktable within the container.

Clause 15: the controller is configured to maintain the energy density of the beam to be between 11 and 57 J/mm$^3$ by controlling movement of the beam with respect to the worktable.

Clause 16: the controller is configured to maintain the energy density of the beam to be between 11 and 57 J/mm$^3$ by controlling a power output of the beam.

Clause 17: the controller is configured to maintain the energy density of the beam to be between 11 and 57 J/mm$^3$ by controlling a size of the beam.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

The invention claimed is:

1. A structure in a solid state, the structure comprising:

a first region in a primary hexagonal close-packed ("HCP") phase; and a second region in a secondary HCP phase forming needles or platelets, the first region and the second region being separated by a columnar grain boundary, wherein the primary HCP phase is a continuous phase along the columnar grain boundary, wherein each of the first region and the second region comprise an alloy of:

50-60 wt. % aluminum; and 40-50 wt. % silver, wherein, at the columnar grain boundary, the silver is segregated from the aluminum, wherein the structure has a density that is at least 90% of a theoretical maximum density of the alloy.

2. The structure of claim 1, wherein the structure has a density that is at least 95% of the theoretical maximum density of the alloy.

3. The structure of claim 1, wherein the structure comprises 50 wt. % aluminum and 50 wt. % silver.

4. The structure of claim 1, wherein the structure comprises 60 wt. % aluminum and 40 wt. % silver.

5. The structure of claim 1, wherein aluminum and silver are in an HCP phase, and wherein the mole fraction of the aluminum in the HCP phase is between 30% and 50%, and the mole fraction of the silver in the HCP phase is between 50% and 70%.

6. The structure of claim 5, wherein aluminum and silver are in a face-centered cubic ("FCC") phase, and wherein the mole fraction of the aluminum in the FCC phase is between 60% and 80%, and the mole fraction of the silver in the FCC phase is between 20% and 40%.

* * * * *